US006243955B1

(12) United States Patent
Forbers et al.

(10) Patent No.: US 6,243,955 B1
(45) Date of Patent: Jun. 12, 2001

(54) HAIR CLIPPER ATTACHMENT DEVICE AND METHOD OF USE

(76) Inventors: Anthony Glen Forbers, 8612 Bliss, Detroit, MI (US) 48234; Christopher Perry Forbers, 5297 Spokane, Detroit, MI (US) 48204

( * ) Notice: Subject to any disclaimer, the term of this patent is extended or adjusted under 35 U.S.C. 154(b) by 0 days.

(21) Appl. No.: 09/292,752

(22) Filed: Apr. 16, 1999

(51) Int. Cl.[7] ..... B26B 19/20

(52) U.S. Cl. ..... 30/233.5; 30/195; 30/208; 30/293

(58) Field of Search ..... 30/233, 233.5, 30/195, 208, 209, 210, 30, 293, 287, 286, 290

(56) References Cited

U.S. PATENT DOCUMENTS

| | | | | |
|---|---|---|---|---|
| 1,582,342 | * | 4/1926 | Moore | 30/210 |
| 2,013,229 | | 9/1935 | Andis | 30/210 |
| 2,265,880 | * | 12/1941 | Wahl | 30/210 |
| 2,275,110 | | 3/1942 | Monti | 30/233 |
| 2,716,809 | | 9/1955 | Malone | 30/30 |
| 2,809,425 | * | 10/1957 | Tettis | 30/233.5 |
| 3,589,007 | | 6/1971 | Walton | 30/140 |
| 3,812,389 | | 5/1974 | Bowerman | 30/210 X |
| 4,557,050 | * | 12/1985 | Haraguchi et al. | 30/195 |
| 4,776,095 | * | 10/1988 | Tsujimoto et al. | 30/233 X |
| 4,825,546 | * | 5/1989 | Araki et al. | 30/195 X |
| 5,054,199 | * | 10/1991 | Ogawa et al. | 30/210 X |
| 5,084,974 | * | 2/1992 | Sukow et al. | 30/233 X |
| 5,092,048 | | 3/1992 | Sukow et al. | 30/210 |
| 5,325,589 | * | 7/1994 | Kubo | 30/195 X |

* cited by examiner

*Primary Examiner*—Charles Goodman
(74) *Attorney, Agent, or Firm*—Richard C. Litman

(57) ABSTRACT

A hair clipper attachment device for making fading haircuts comprising a driving disc connected to a cylindrical drives element which has a half-cylinders shaped cam for moving a cam follower element which moves the carriage of an electric hair clipper to increase the depth of a cut in hair as the hair clipper progresses by contact from the neck to the head. The driving disc can be removed and the cylindrical drive element moved manually by a digit to obtain a fading haircut.

7 Claims, 4 Drawing Sheets

HAIR CLIPPER ATTACHMENT DEVICE AND METHOD OF USE

BACKGROUND OF THE INVENTION

1. Field of the Invention

The present invention relates to a hair clipper attachment device for a fading haircut, i.e, forming a gradual increase in the length of hair cut from the neck to the head.

2. Description of the Related Art

The relevant art does not recognize the need for performing a fading function in hair cutting, because barbers rely on their skill in elevating the cutting blade as the hair is cut longer from the neck. However, the present invention can be readily removably attached to a modern electric hair cutter to enable one with less skill to perform the fading cut.

The related art of interest describes various hair clipper attachment devices. The related art will be discussed in the order of perceived relevance to the present invention.

U.S. Pat. No. 2,716,809 issued on Sep. 6, 1955, to Carl F. Malone describes a manually operated hair cutter having a blade assembly slidably mounted on an oscillatory comb member. The blade assembly is urged forward by moving the hair cutter on a pair of sponge rubber treaded wheels to cut hair progressively shorter as the hair cutter travels over the hair. The hair cutter is distinguishable for the opposite effect of cutting hair shorter as the device is urged forward on the hair, a manual cutter with only one cutting effect, and the reliance on a pair of wheels to activate the cutter.

U.S. Pat. No. 2,275,110 issued on Mar. 3, 1942, to Philip Monti describes an attachment to a manually operated hair clipper to obtain a frictionless surface of the clipper for contact with the skin during the cutting operation. The frictionless surface is provided by a series of rollers arranged in parallel relationship to one another and transversely across the cutter head. The roller attachment is distinguishable for lacking the mechanical ability to enable a change in the cutting height.

U.S. Pat. No. 5,092,048 issued on Mar. 3, 1992, to Daniel L. Sukow et al. describes a spring-biased cutting head assembly for electric hair trimmers which can be releasably and operably mounted on hair trimmers having differently configured support tongues with or without ribs on a lower surface. The cutting head assembly is distinguishable for its adaptation only to different trimmers and is not concerned with fading during hair cutting.

U.S. Pat. No. 2,013,229 issued on Sep. 3, 1935, to Mathew Andis describes a power driven hair clipper with an actuator for the movable blade supported by a set of crossed flat springs which permit a swinging movement and the actuator provided with an armature in the magnetic field. The hair clipper is distinguishable for not having a mechanical cutting height adjustment.

U.S. Pat. No. 3,589,007 issued on Jun. 29, 1971, to William M. Walton describes an electric hair clipper operating on a rechargeable battery. The hair clipper is distinguishable for lacking a mechanical cutting height adjustment.

U.S. Pat. No. 3,812,389 issued on May 21, 1974, to Leonard E. Bowerman describes an electric hair clipper with an improved blade driving means comprising a vibratory motor with an armature that is pivotally supported by an upright bearing. The clipper is distinguishable for not having a mechanical cutting height adjustment.

None of the above inventions and patents, taken either singularly or in combination, is seen to describe the instant invention as claimed. Thus, a hair clipper attachment solving the aforementioned problems is desired.

SUMMARY OF THE INVENTION

The present invention is a hair clipper attachment device for a fading haircut. The attachment is made up of four parts, these being: a disc having a central aperture; a cylindrical driver element having a center throughbore, and a half-cylinder shaped cam projecting from its rear surface; a cam follower element including a horizontal slot containing lobes communicating with a vertical slot on the top side of the cam, the cam follower element further having a long leg portion on its right side along the top side extending perpendicularly rearward and a short leg portion on its bottom side extending perpendicularly rearward; and an extended length fastener for adjustment penetrating the apertures of the disc, the driver element, the horizontal slot of the cam follower element, and a pre-existing aperture in a hair clipper to secure the hair clipper attachment device to the hair clipper. An alternative embodiment is the omission of the disc and the manipulation of the cylindrical drive element by a digit for effectuating a fading haircut.

Accordingly, it is a principal object of the invention to provide a hair clipper attachment device for an electric hair cutter to perform fading by manually or automatically moving the cutter blade relative to the comb of the hair clipper.

It is another object of the invention to provide a hair clipper attachment device with a disc or side wheel to perform fading automatically by moving the hair clipper forward and upwards from the neck to a person's head.

It is a further object of the invention to provide a hair clipper attachment device to perform fading manually by rotating a cylindrical driver element with a digit.

Still another object of the invention is to provide a hair clipper attachment device to perform fading by operation of a cylindrical driver element, a disc or side wheel, a half-cylinder shaped can and a notched cam follower device.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention provides a unique means for performing fading operations in hair cutting with an electric hair cutter.

Figure 1:
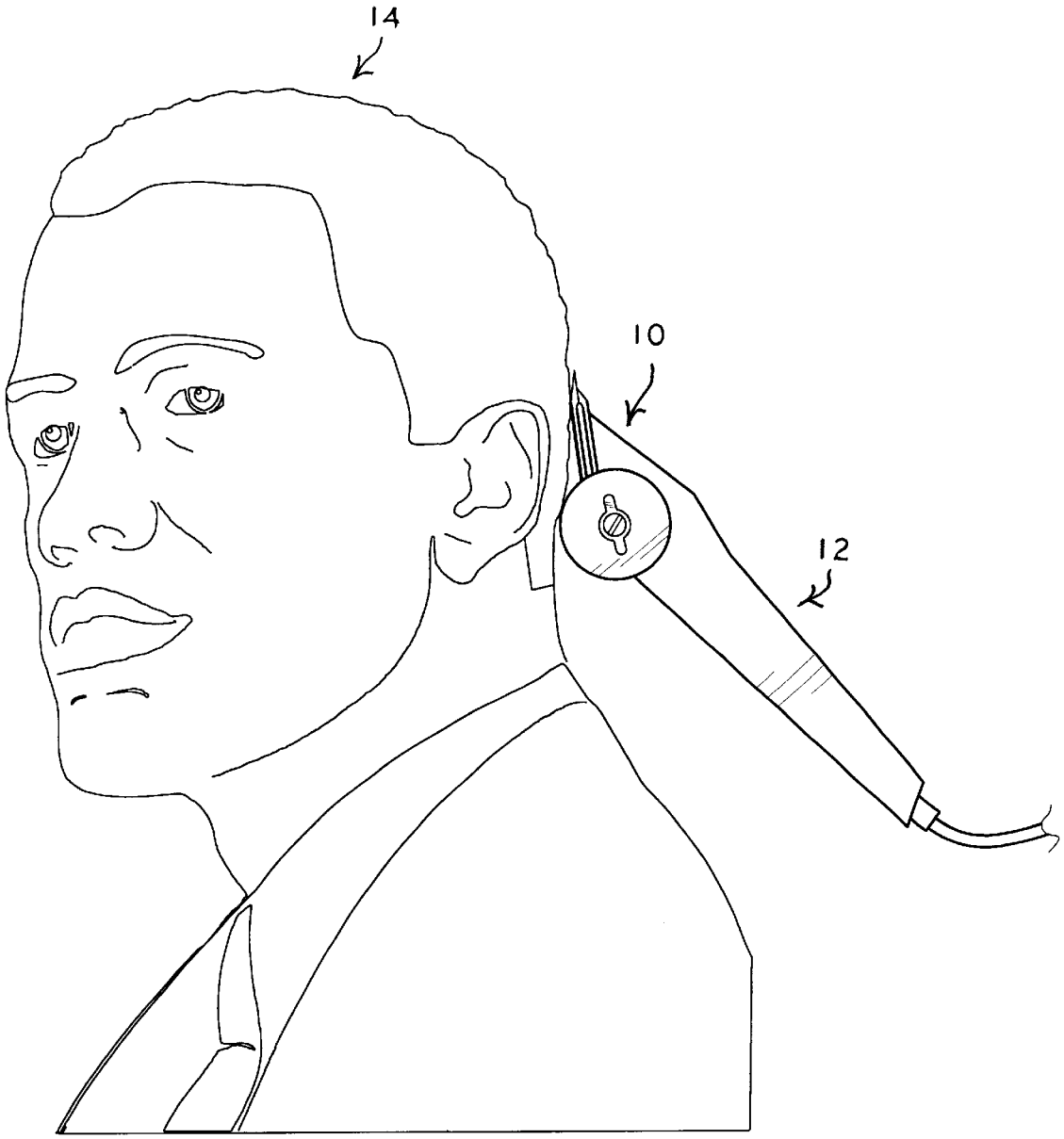
FIG. 1 is a perspective view of a hair clipper attachment device on a clipper fading a person's hair according to the present invention.

FIG. 1 illustrates the hair clipper attachment device 10 installed on an electric hair clipper 12, e.g., a WAHL™ brand clipper, and being used to perform a fading cut, i.e., increasing the height of the cut or cutting less hair, on a person 14, the cut progressing from the neck upwards to the head.

Figure 2:
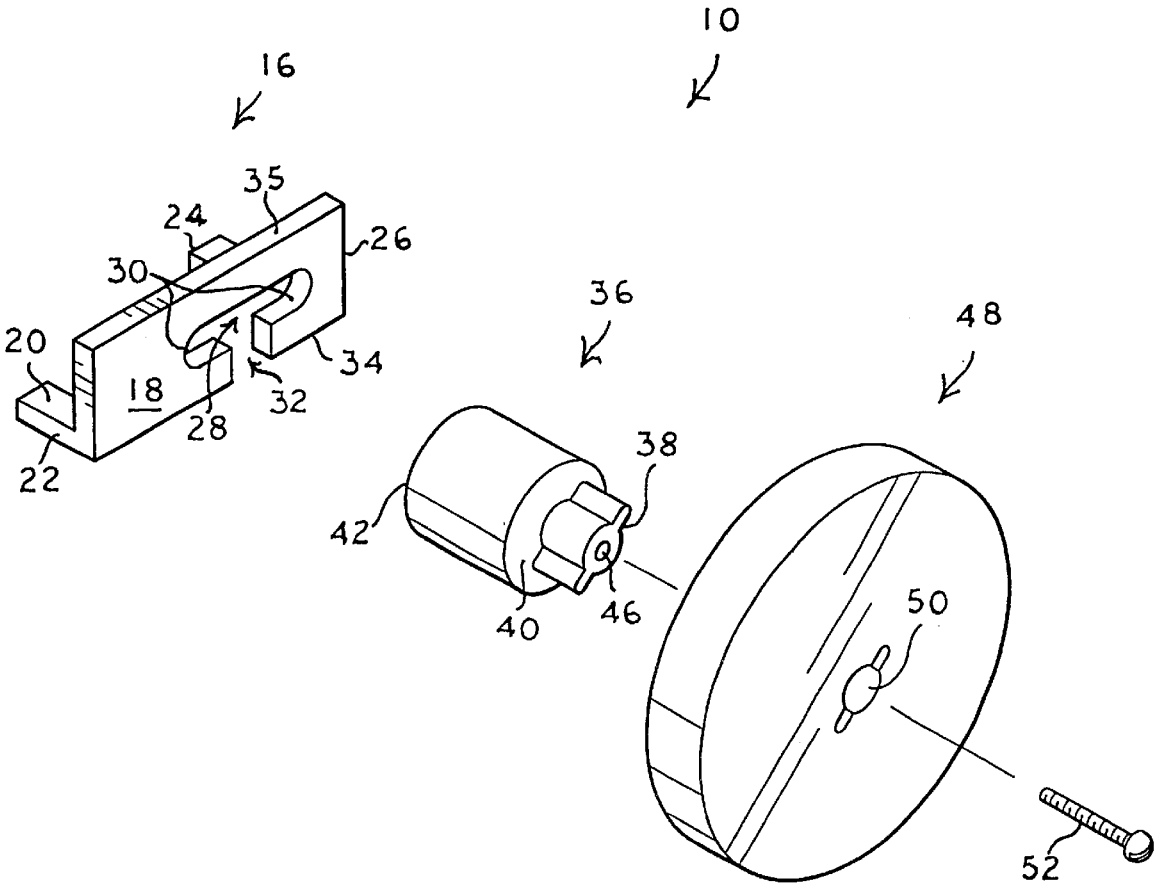
FIG. 2 is an exploded view of the hair clipper attachment device.

In FIG. 2, the attachment device 10 is depicted as consisting of four parts. The first part is a plastic or metal bracket or cam follower element 16 configured in the shape of an C (as viewed from above, but depicted in an inverted position; see also in FIG. 4) with a planar front portion 18 and a top side 35 providing a structural backbone for the longer leg portion 20 on the right side 22 extending rearward. Another shorter leg portion 24 extends rearward proximate the left side 26 of the cam follower 16. A horizontal slot 28 has two lobes 30 bifurcating from a vertical slot 32 on a bottom edge 34 of the cam follower 16. It should be noted that this description is applied to an inverted cam follower element 16 shown in FIG. 2 due to the inverted hair clipper 12 shown in FIG. 4.

Figure 3:
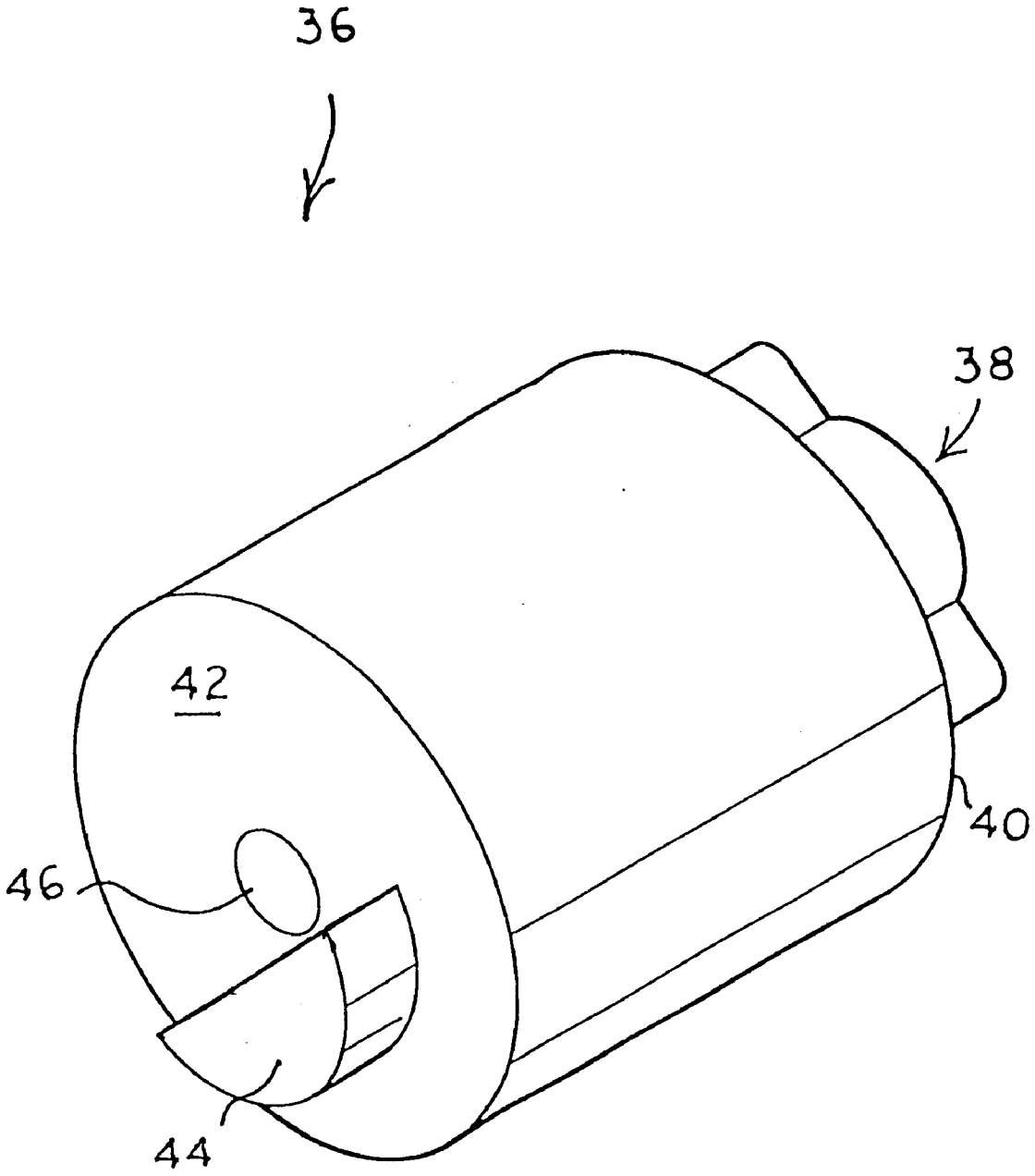
FIG. 3 is a rear perspective view of the cylindrical driver element of the hair clipper attachment device.
Figure 4:
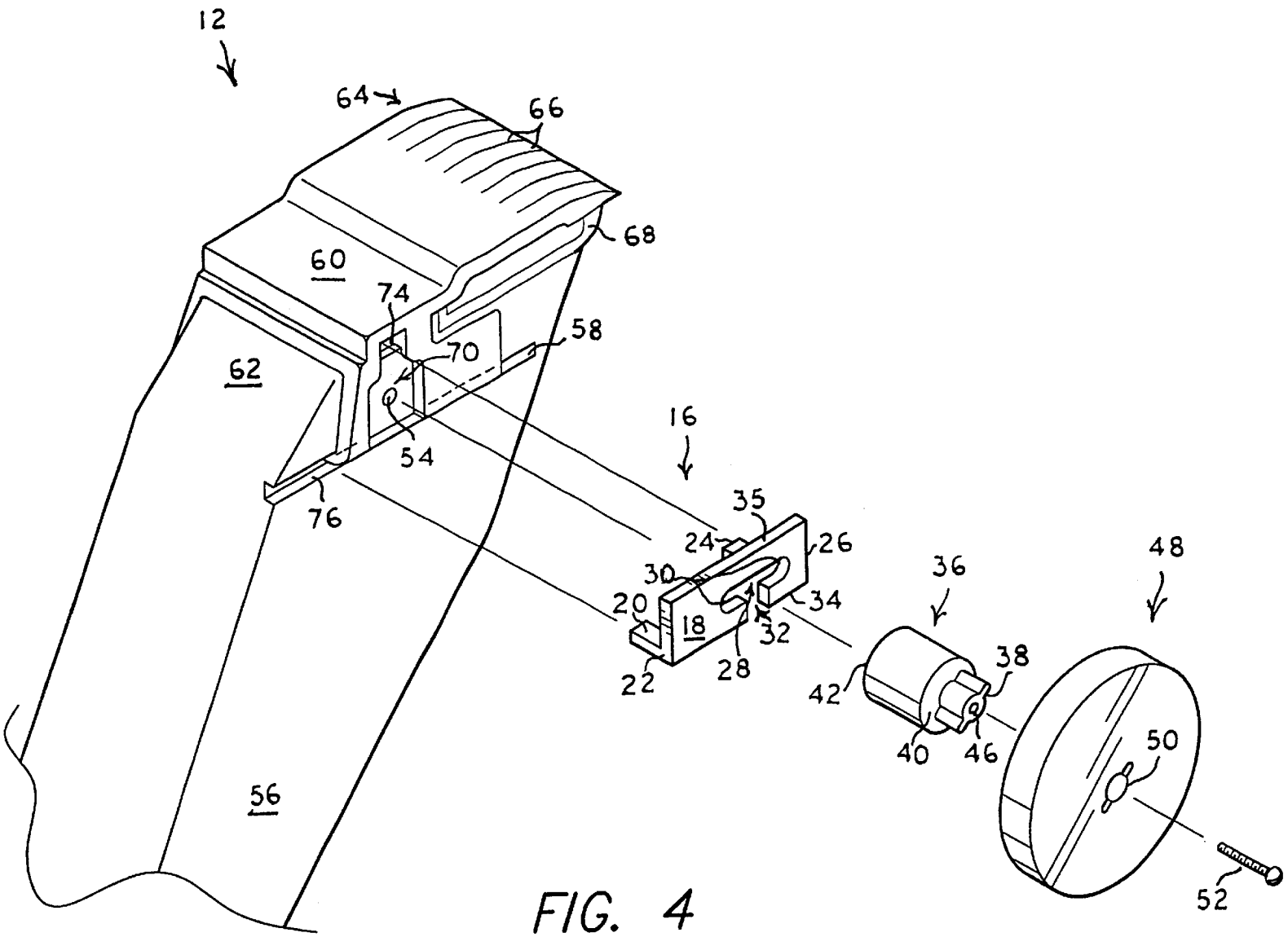
FIG. 4 is an exploded view of the hair clipper attachment device relative to a partial perspective view of the hair clipper shown inverted.

The second part is a cylindrical driver element 36 shown also enlarged in FIG. 3 and viewed from behind. The driver element 36 in FIGS. 2 and 4 is viewed from the front as having a lobed projection 38 with a central aperture 46 on a front side surface 40. The rear side surface 42 in FIG. 3 has a half-cylinder shaped cam 44 and the aperture 46 centered in the driver element 36.

The third part shown in FIG. 2 is a plastic disc 48 having a lobed aperture 50 for insertion of the lobed projection 38 of the driver element 36. The fourth part is a fastener 52 of an extended length which joins the three aforementioned parts and is inserted into the aperture 54 of the hair clipper 12 shown in an inverted position in FIG. 4.

The conventional hair clipper 12 comprises a handle 56 having a slot 58 which accommodates the carriage 60 in the base portion 62. The carriage 60 comprises a comb element 64 having elongated teeth 66. A cutter element or blade 68 is conventionally oscillated sideways to cut the protruding hair.

In FIG. 4, the carriage 60 has a bell-shaped aperture 70 which exposes the base portion 62 to accommodate the attachment of the device 10 by the fastener 52 into the blind bore or aperture 54. It should be noted that the aperture 70 is actually an inverted bell shape as viewed with the teeth 66 as the bottom surface of the inverted electric hair clipper 12. There is an aperture 74 for insertion of the shorter leg portion 24 and similarly shaped in cross-section. The longer leg portion 20 fits into the space 76 at the rear of the carriage 60. Conventionally, the carriage 60 is adjusted to a fixed position vis-a-vis the blade 68 by the barber as a one-time adjustment to suit the barber's preference.

In the present invention, the hair clipper attachment device 10 modifies the operation of a fixed cutting position, i.e., the distance between the forward edges of the teeth 66 of the comb element 64 and the forward edge of the blade 68. This modification is performed by rotating the disc 48 and/or the cylindrical driver element 36 in one direction, i.e., counter-clockwise, by the friction of the head and the hair being cut upwards from the neck to cause the half-cylinder shaped cam 44 of the driver element 36 engaging the vertical slot 32 of the cam follower element 16 to force the cam follower element and the carriage 60 to move forward relative to the stationary cutter element or blade 68. The leg portion 24 contacting the carriage 60 aids this displacement. For returning the carriage 60 to its original position, the disc 48 and/or the cylindrical driver element 36 is rotated clockwise to a starting short hair cutting position.

It should be noted that the wheel or plastic disc 48 can be removed and the cutter blade 68 can still be adjusted manually by a digit moving the cylindrical drive element 36 for effectuating a fading haircut.

It is to be understood that the present invention is not limited to the embodiment described above, but encompasses any and all embodiments within the scope of the following claims.

We claim:

1. A hair clipper attachment device in combination with a hair clipper for performing a fading haircut, wherein:

said hair clipper comprises:

a handle with a base portion including a carriage and a side slot, said carriage having a comb element with long teeth, and a cutter element with short teeth adapted to oscillate from side to side for cutting hair;

an inverted bell shaped cutout in the carriage adjacent the slot, said cutout including a center bore;

said hair clipper attachment device comprises:

a cylindrical driver element having a central aperture, a front surface, a rear surface, a lobed projection on the front surface and a half-cylinder shaped cam projecting from the rear surface;

a cam follower element having a planar front surface, a left side, a right side, a top side and a bottom side, the front surface including a horizontal slot containing lobes communicating with a vertical slot extending from the bottom side;

the cam follower element further having a long leg portion extending perpendicularly rearward from the right side, and a short leg portion extending perpendicularly rearward from the left side;

a rotatable disc having a lobed aperture for receiving the lobed projection of said driver element; and an extended length fastener penetrating the aperture of the disc, the aperture of the driver element, the horizontal slot of the cam follower element, and the bore of the inverted bell shaped cutout to secure the hair clipper attachment device to the hair clipper;

whereby a fading haircut is obtained by rotating the cylindrical driver element in a counter-clockwise direction.

2. The hair clipper attachment device in combination with a hair clipper according to claim 1, wherein the comb element of the hair clipper is arranged and configured so as to be returned to its original position by rotating the cylindrical driver element in a clockwise direction.

3. The hair clipper attachment device in combination with a hair clipper according to claim 1, wherein the half-cylinder shaped cam projecting from the rear surface of the cylindrical driver element is arranged and configured so as to cooperate with and abut the vertical slot of the cam follower element to urge the comb element forward as the cylindrical driver element is rotated.

4. The hair clipper attachment device in combination with a hair clipper according to claim 1, wherein the long leg portion of the cam follower element is dimensioned to fit into the side slot in the base portion of the handle of the hair clipper, whereby the cam follower element is stabilized with rotation of the cylindrical driver element.

5. The hair clipper attachment device in combination with a hair clipper according to claim 1, wherein the short leg portion of the cam follower element is configured so as to be positioned in an aperture of the bell shaped cutout to move the carriage as the disc is rotated.

6. The hair clipper attachment device in combination with a hair clipper according to claim 1, wherein the half-cylinder shaped cam projecting from the rear surface of the cylindrical driver element is arranged and configured so as to cooperate with and abut the vertical slot of the cam follower element to urge the comb element forward as the disc is rotated.

7. A hair clipper attachment device for a hair clipper to obtain a fading haircut, said device comprising:

a cylindrical driver element having a central aperture, a front surface, a rear surface, a lobed projection on the front surface and a half-cylinder shaped cam projecting from the rear surface;

a cam follower element having a planar front surface, a left side, a right side, a top side and a bottom side, the front surface including a horizontal slot containing lobes communicating with a vertical slot extending from the bottom side;

the cam follower element further having a long leg portion extending perpendicularly rearward from the right side, and a short leg portion extending perpendicularly rearward from the left side;

a rotatable disc having a lobed aperture for receiving the lobed projection of said driver element; and an extended length fastener penetrating the aperture of the disc, the aperture of the driver element, and the horizontal slot of the cam follower element for securing the hair clipper attachment device to the hair clipper.

* * * * *